US005763147A

United States Patent [19]

Haye et al.

[11] Patent Number: 5,763,147

[45] Date of Patent: Jun. 9, 1998

[54] METHOD FOR PROCESSING HIGH SILVER BROMIDE COLOR NEGATIVE PHOTOGRAPHIC FILMS USING A PEROXIDE BLEACHING COMPOSITION

[75] Inventors: Shirleyanne Elizabeth Haye; Cheryl Ann Wilson-Bonner; Karen Ruth Ballou, all of Rochester, N.Y.

[73] Assignee: Eastman Kodak Company, Rochester, N.Y.

[21] Appl. No.: 625,181

[22] Filed: Mar. 29, 1996

Related U.S. Application Data

[63] Continuation-in-part of Ser. No. 391,805, Feb. 21, 1995, abandoned.

[51] Int. Cl.[6] ..... G03C 5/44; G03C 5/12

[52] U.S. Cl. ..... 430/393; 430/430; 430/461; 430/943; 430/488; 430/491; 430/490; 430/493

[58] Field of Search ..... 430/393, 430, 430/461, 943, 488, 491, 490, 493

[56] References Cited

U.S. PATENT DOCUMENTS

| | | | |
|---|---|---|---|
| 3,839,045 | 10/1974 | Brown | 430/491 |
| 4,301,236 | 11/1981 | Idota et al. | 430/393 |
| 4,328,306 | 5/1982 | Idota | 430/393 |
| 4,737,450 | 4/1988 | Hall et al. | 430/393 |
| 5,318,880 | 6/1994 | English et al. | 430/430 |
| 5,324,624 | 6/1994 | Twist | 430/399 |
| 5,550,009 | 8/1996 | Haye et al. | 430/393 |
| 5,554,491 | 9/1996 | O'Toole et al. | 430/393 |
| 5,578,428 | 11/1996 | Fyson | 430/398 |
| 5,607,820 | 3/1997 | Nakamura | 430/393 |

FOREIGN PATENT DOCUMENTS

| | | | |
|---|---|---|---|
| 0428101A1 | 5/1991 | European Pat. Off. | G03C 7/42 |
| 0678783 | 10/1995 | European Pat. Off. | G03C 7/42 |
| 0679945 | 11/1995 | European Pat. Off. | G03C 7/42 |
| 2373080 | 8/1978 | France | G03C 5/52 |
| 56-121035 | 9/1981 | Japan | G03C 5/44 |
| 2-153349 | 6/1990 | Japan | G03C 7/42 |
| 92/07300 | 4/1992 | WIPO | G03C 7/44 |
| 93/11459 | 6/1993 | WIPO | G03C 7/42 |

OTHER PUBLICATIONS

Research Disclosure, Jan., 1981, p. 6, No. 20111, by C.R.Coppel et al.

*Primary Examiner*—Mark F. Huff

*Attorney, Agent, or Firm*—J. Lanny Tucker

[57] ABSTRACT

A simple and effective peroxide bleaching method includes the use of a bleaching solution including a peroxide bleaching agent and chloride ion in an amount of at least 0.35 mol/l. An organic phosphonic acid or tertiary aminocarboxylic acid can also be present for stability. The method is useful for bleaching high silver bromide color negative photographic films containing at least 80 mol % silver bromide and from 0.5 to 5 mol % silver iodide in at least one silver halide emulsion.

19 Claims, No Drawings

METHOD FOR PROCESSING HIGH SILVER BROMIDE COLOR NEGATIVE PHOTOGRAPHIC FILMS USING A PEROXIDE BLEACHING COMPOSITION

RELATED APPLICATION

This application is a Continuation-in-Part of U.S. Ser. No. 08/391,805, filed Feb. 21, 1995, now abandoned.

Another related application is commonly assigned U.S. Ser. No. 08/625,055, filed on even date herewith by Haye, O'Toole, Cole and Buchanan and entitled "Method for Processing Color Photographic Films Using A Peroxide Bleaching Composition".

FIELD OF THE INVENTION

The present invention relates generally to the processing of color negative photographic films. More particularly, it relates to the use of peroxide bleaching solutions comprising a certain amount of chloride ion to bleach such films.

BACKGROUND OF THE INVENTION

During processing of silver halide photographic elements, the developed silver is oxidized to a silver salt by a suitable bleaching agent. The oxidized silver is then removed from the element in a fixing step.

The most common bleaching solutions contain complexes of ferric ion and various organic ligands. One primary desire in this industry is to design bleaching compositions that are more compatible with the environment. Thus it is desirable to reduce or avoid the use of ferric complexes as bleaching agents.

Peracid bleaching solutions, such as those containing peroxide, persulfate, perborate, perphosphate, perhalogen, percarboxylic acid or percarbonate bleaching agents, offer an alternative to the ferric complex bleaching solutions. They are less expensive and present lower chemical and biological demands on the environment since their by-products can be less harmful.

While persulfate bleaching agents have low environmental impact, they have the disadvantage that their bleaching activity is slow and thus require the presence of a bleaching accelerator. The most common bleaching accelerators are thiol compounds that have offensive odors.

Because hydrogen peroxide reacts and decomposes to form water, a peroxide based bleaching solution offers many environmental advantages over persulfate and ferric complex bleaching solutions. As a result, many publications describe peroxide bleaching solutions, including U.S. Pat. No. 4,277,556 (Koboshi et al), U.S. Pat. No. 4,301,236 (Idota et al), U.S. Pat. No. 4,454,224 (Brien et al), U.S. Pat. No. 4,717,649 (Hall et al) and WO-A-92/01972 (published Feb. 6, 1992).

In addition, WO-A-92/07300 (published Apr. 30, 1992) and EP 0 428 101A1 (published May 22, 1991) describe peroxide compositions for bleaching high chloride silver halide emulsions (that is, silver halide emulsions having 80–100 mol % silver chloride, and preferably 90 mol % silver chloride). Processing emulsions with less silver chloride using peroxide bleaching solutions is discouraged in EP 0 428 101A1 as being too lengthy. The bleaching compositions described therein comprise chloride ions at up to 0.4 mol/l of solution and have a pH in the range of 5 to 11.

Despite all of the efforts of researchers in the art, no peroxide bleaching composition has been commercialized because of various problems including vesiculation (that is, blistering of the photographic element from evolution of oxygen) and poor bleaching efficiency.

There remains a need, therefore, for a way to rapidly bleach color negative films containing low amounts of silver chloride in the emulsions without causing vesiculation.

SUMMARY OF THE INVENTION

The noted problems are solved with a method for processing a color photographic element comprising:

bleaching an imagewise exposed and developed color negative photographic film containing a silver halide emulsion having at least about 80 mol % silver bromide, and from about 0.5 to about 5 mol % silver iodide, with a peroxide bleaching solution comprising:

a peroxide bleaching agent, and chloride ions present in an amount of at least 0.35 mol/l.

The method of this invention provides rapid and efficient bleaching of imagewise exposed and developed color negative photographic films containing silver halide emulsions containing at least about 80 mol % silver bromide, and a very small amount of silver iodide, and avoids the problems noted above with known peroxide bleaching solutions. No vesiculation was observed with the use of the present invention. Moreover, the bleaching solutions present little environmental harm.

These advantages are achieved by using a peroxide bleaching solution that contains chloride ion in an amount of at least 0.35 mol/l of solution. In preferred embodiments, the solution also contains an organic phosphonic acid or a tertiary aminocarboxylic acid, or a salt thereof to increase stability.

DETAILED DESCRIPTION OF THE INVENTION

Peroxide bleaching solutions useful in this invention comprise a conventional peroxide bleaching agent including, but not limited to hydrogen peroxide, alkali and alkaline earth salts of peroxide, or a compound which releases or generates hydrogen peroxide. Such hydrogen peroxide precursors are well known in the art, and include for example, perborate, percarbonate, and hydrogen peroxide urea. In addition, hydrogen peroxide can be generated on site by electrolysis of aqueous solutions. Examples of peroxide bleaching solutions are described, for example, in *Research Disclosure*, publication 36544, pages 501–541 (September 1994). Research Disclosure is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*". Hydrogen peroxide is a preferred bleaching agent.

The amount of hydrogen peroxide (or its precursor) is generally at least 0.15 mol/l, and from about 0.15 to about 3 mol/l is preferred. The optimum amount will depend upon the particular color negative film being processed. The most preferred amounts for silver bromoiodide emulsions are from about 1.45 to about 2.0 mol/l.

Chloride ions can be supplied to the bleaching solution as part of a simple inorganic salt, such as an ammonium or alkali metal ion salt (for example, sodium chloride, potassium chloride, lithium chloride and ammonium chloride). In addition, they can be supplied as organic complexes such as tetraalkylammonium chlorides. Preferred salts are sodium chloride and potassium chloride.

The chloride ion concentration is at least 0.35 mol/l, with from 0.35 to about 2 mol/l being preferred, and from 0.35 to about 0.75 mol/l being most preferred.

The bleaching solution useful in this invention is quite simple, having only two essential components, the peroxide bleaching agent and chloride ions. Other optional and preferred components include a buffer, and an organic phosphonic acid or a tertiary aminocarboxylic acid, both of which are defined below.

Moreover, the bleaching solution is alkaline, having a pH within the general range of from about 8 to about 12, with a pH of from about 9 to about 11 being preferred. The pH can be provided by adding a conventional weak or strong base, and can be maintained by the presence of one or more suitable buffers including, but not limited to, sodium carbonate, potassium carbonate, sodium borate, potassium borate, sodium phosphate, calcium hydroxide, sodium silicate, β-alaninediacetic acid, arginine, asparagine, ethylenediamine, ethylenediaminetetraacetic acid, ethylenediaminedisuccinic acid, glycine, histidine, imidazole, isoleucine, leucine, methyliminodiacetic acid, nicotine, nitrilotriacetic acid, piperidine, proline, purine and pyrrolidine. Sodium carbonate and potassium carbonate are preferred.

The amount of useful buffer or base would be readily apparent to one skilled in the art.

The bleaching solution preferably comprises one or more organic phosphonic acids or salts thereof. Generally such compounds are represented by the structure (I):

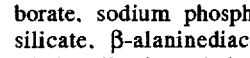

$$R_1N(CH_2PO_3M_2)_2$$

or (II):

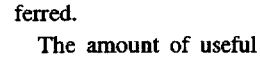

$$R_2R_3C(PO_3M_2)_2$$

wherein $R_1$ is hydrogen, a substituted or unsubstituted alkyl group of 1 to 12 carbon atoms (such as methyl, hydroxymethyl, ethyl, isopropyl, t-butyl, hexyl, octyl, nonyl, decyl, benzyl, 4-methoxybenzyl, β-phenethyl, o-acetamidobenzyl or β-phenethyl), a substituted or unsubstituted alkylaminoalkylene group (wherein the alkyl or alkylene has 1 to 12 carbon atoms, such as methylaminomethylene or ethylaminoethylene), a substituted or unsubstituted alkoxyalkyl group of 1 to 12 carbon atoms (such as methoxymethyl, methoxyethyl, propoxyethyl, benzyloxy, methoxymethylenemethoxymethyl or t-butoxy), a substituted or unsubstituted cycloalkyl group having 5 to 10 carbon atoms in the ring (such as cyclopentyl, cyclohexyl, cyclooctyl or 4-methylcyclohexyl), a substituted or unsubstituted aryl group having 6 to 10 carbon atoms in the ring (such as phenyl, xylyl, tolyl, naphthyl, p-methoxyphenyl or 4-hydroxyphenyl), or a substituted or unsubstituted heterocyclic group having one or more nitrogen, oxygen or sulfur atoms, and a total of 5 to 10 atoms, in the ring [such as pyridyl, pyrimidyl, pyrrolyldimethyl, pyrrolyldibutyl, benzothiazolylmethyl, tetrahydroquinolylmethyl, 2-pyridinylmethyl, 4-(N-pyrrolidino)butyl or 2-(N-morpholino)ethyl].

$R_2$ is hydrogen, a substituted or unsubstituted alkyl group of 1 to 12 carbon atoms (as defined above), a substituted or unsubstituted aryl group of 6 to 10 carbon atoms in the ring (as defined above), a substituted or unsubstituted cycloalkyl group of 5 to 10 carbon atoms in the ring (as defined above), a substituted or unsubstituted heterocyclic group having 5 to 10 atoms in the ring (as defined above), $—PO_3M_2$ or $—CHR_4PO_3M_2$.

$R_3$ is hydrogen, hydroxyl, a substituted or unsubstituted alkyl group of 1 to 12 carbon atoms (defined above) or $—PO_3M_2$.

$R_4$ is hydrogen, hydroxyl, a substituted or unsubstituted alkyl group of 1 to 12 carbon atoms (as defined above) or $—PO_3M_2$.

M is hydrogen or a water-soluble monovalent cation imparting water-solubility such as an alkali metal ion (for example sodium or potassium), or ammonium, pyridinium, triethanolammonium, triethylammonium ion or others readily apparent to one skilled in the art. The two cations in each molecule do not have to be the same. Preferably, M is hydrogen, sodium or potassium.

In defining the substituted monovalent groups above, useful substituents include, but are not limited to, an alkyl group, hydroxy, sulfo, carbonamido, sulfonamido, sulfamoyl, sulfonato, thialkyl, alkylcarbonamido, alkylcarbamoyl, alkylsulfonamido, alkylsulfamoyl, carboxyl, amino, halo (such as chloro or bromo) sulfono, or sulfoxo, alkoxy of 1 to 5 carbon atoms (linear or branched), $—PO_3M_2$, $—CH_2PO_3M_2$ or $—N(CH_2PO_3M_2)_2$ wherein the alkyl (linear or branched) for any of these groups has 1 to 5 carbon atoms.

Representative phosphonic acids useful in the practice of this invention include, but are not limited to the compounds listed in EP 0 428 101A1 (page 4), as well as the following compounds:

ethylenediamine-N,N,N',N'-tetramethylenephosphonic acid,
nitrilo-N,N,N-trimethylenephosphonic acid,
1,2-cyclohexanediamine-N,N,N',N'-tetramethylenephosphonic acid,
o-carboxyaniline-N,N-dimethylenephosphonic acid,
propylamine-N,N-dimethylenephosphonic acid,
4-(N-Pyrrolidino)butylamine-N,N-bis(methylenephosphonic acid),
1,3-diamino-2-propanol-N,N,N',N'-tetramethylenephosphonic acid,
1,3-propanediamine-N,N,N',N'-tetramethylenephosphonic acid,
1,6-hexanediamine-N,N,N',N'-tetramethylenephosphonic acid,
o-acetamidobenzylamine-N,N-dimethylenephosphonic acid,
o-toluidine-N,N-dimethylenephosphonic acid,
2-pyridylmethylamine-N,N-dimethylenephosphonic acid,
1-hydroxyethane-1,1-diphosphonic acid,
diethylenetriamine-N,N,N',N",N"-penta(methylenephosphonic acid),
1-hydroxy-2-phenylethane-1,1-diphosphonic acid,
2-hydroxyethane-1,1-diphosphonic acid,
1-hydroxyethane-1,1,2-triphosphonic acid,
2-hydroxyethane-1,1,2-triphosphonic acid,
ethane-1,1-diphosphonic acid, and
ethane-1,2-diphosphonic acid.

Most useful are 1-hydroxyethane-1,1-diphosphonic acid, nitrilo-N,N,N-trimethylenephosphonic acid, diethylenetriamine-N,N,N',N",N"-penta(methylenephosphonic acid), or salts thereof. The first compound is most preferred.

The amount of organic phosphonic acid used in the practice of the invention can be at least about 0.001 mol/l and generally up to about 0.02 mol/l. An amount of from about 0.004 to about 0.012 mol/l is preferred.

Instead of, or in addition to, the phosphonic acids (or salts) described above, the bleaching solution can also contain one or more aminocarboxylic acids (or salts thereof) that contain a tertiary amine. These compounds can be represented by the structure (III):

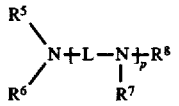

wherein $R^5$, $R^6$, $R^7$ and $R^8$ are independently hydroxyalkyl of 1 to 3 carbon atoms, or carboxyalkyl of 2 to 4 carbon atoms, provided at least one of these groups is carboxyalkyl. The alkyl groups are substituted or unsubstituted and can be branched or linear. The alkyl groups can also be hydroxy-substituted. Preferably, the hydroxyalkyl or carboxyalkyl groups have methyl or ethyl groups.

In structure III, p is 0 or an integer of 1 to 3.

L is a substituted or unsubstituted alkylene group of 2 to 4 carbon atoms (linear or branched, and substituted with hydroxy or carboxy). L can also be a $$-(CH_2)_x-(O\ CH_2$$

group wherein x and y are independently integers of 2 to 4, and z is an integer of 1 to 3. Moreover, L can be a 6-membered substituted or unsubstituted cyclic alkylene group (optionally substituted with hydroxy or carboxy) or a substituted or unsubstituted arylene group of 6 to 10 carbon atoms in the ring (such as phenylene or naphthylene, optionally substituted with hydroxy or carboxy). Preferably, the compound of structure III has more than one carboxy group.

Representative tertiary aminocarboxylic acids useful in this invention include, but are not limited to, diethylenetriaminepentaacetic acid, and 2-hydroxypropylenediaminetetraacetic acid, or salts thereof. The first compound is preferred.

Other addenda commonly added to peroxide bleaching solutions can also be included, such as corrosion inhibitors, optical whitening agents, defoaming agents, calcium sequestrants, peroxide stabilizers, radical scavengers, halogen scavengers, and other materials readily apparent to one skilled in the art.

The color negative photographic films to be processed using the present invention can contain any of the conventional silver halide emulsions as the photosensitive material as long as the emulsion contains at least about 80 mol % silver bromide and from about 0.5 to about 5 mol % silver iodide. Preferably, the amount of silver bromide is at least about 90 mol %, and more preferably, it is at least about 95 mol %. Also, the amount of silver iodide is from about 0.5 to about 2 mol %. Useful emulsions include those prepared from silver bromide, silver bromoiodide and silver chlorobromoiodide.

The photographic elements processed in the practice of this invention can be single or multilayer color films. Multilayer color elements typically contain dye image-forming units sensitive to each of the three primary regions of the visible spectrum (thus, such elements contain 3 color records). Each unit can be comprised of a single emulsion layer or multiple emulsion layers sensitive to a given region of the spectrum. Preferably, each color record or unit has at least one silver halide emulsion comprising at least about 95 mol % silver bromide and from about 0.5 to about 2 mol % silver iodide. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports.

Considerable details of the element structure and components, and suitable methods of processing various types of elements are described in *Research Disclosure*, noted above. All types of emulsions can be used in the elements, including but not limited to, thin tabular grain emulsions.

The films processed according to this invention have an ISO speed rating of at least 25, and preferably an ISO speed of at least 50. The speed or sensitivity of color negative photographic films is inversely related to the exposure required to enable the attainment of a specified density above fog after processing. Photographic speed for color films with a gamma of about 0.65 has been specifically defined by the American National Standards Institute (ANSI) as ANSI Standard Number PH2.27-1979 (ASA speed) and relates to the exposure level required to enable a density of 0.15 above fog in the green light sensitive and least sensitive recording unit of a multicolor film. This definition conforms to the International Standards Organization (ISO) film speed rating.

The elements are typically exposed to suitable radiation to form a latent image and then processed to form a visible dye image. Processing includes the step of color development in the presence of a color developing agent to reduce developable silver halide and to oxidize the color developing agent. Oxidized color developing agent in turn reacts with a color-forming coupler to yield a dye.

Color developers are well known and described in hundreds of publications including the *Research Disclosure*, noted above. In addition to color developing agents, the color developers generally contain a buffer (such as potassium carbonate), chelating agents, halides, and one or more antioxidants as preservatives. There are many classes of useful antioxidants including, but not limited to, sulfites, hydrazines and substituted or unsubstituted hydroxylamines. By substituted hydroxylamines is meant, for example, those having one or more alkyl or aryl groups connected to the nitrogen atom. These alkyl or aryl groups can be further substituted with one or more groups such as sulfo, carboxy, hydroxy, alkoxy and other groups known in the art which provide solubilizing effects. Examples of such hydroxylamines are described, for example, in U.S. Pat. No. 4,876,174 (Ishikawa et al), U.S. Pat. No. 4,892,804 (Vincent et al), U.S. Pat. No. 5,178,992 (Yoshida et al) and U.S. Pat. No. 5,354,646 (Kobayashi et al).

Development can also be carried out using what is known in the art as a "developer/amplifier" solution, as described U.S. Pat. No. 5,324,624 (Twist).

Development is then followed by the use of a peroxide bleaching solution according to the practice of this invention. The bleaching step can be carried out in any suitable fashion, as is known in the art. Color prints and films can be processed using a wide variety of processing protocols, as described for example, in *Research Disclosure*, noted above, and thus can include various combinations of one or more bleaching, fixing, washing or stabilizing steps in various orders, and lastly, drying. Additionally, reversal processes include additional steps of black and white development, chemical fogging, re-exposure, and washing prior to color development.

Bleaching is generally carried out for up to about 480 seconds, but shorter times can be used if desired, depending upon the emulsion being processed. Bleaching is generally carried out at a temperature that is at or above room temperature, for example from about 25° to about 60° C., and preferably from about 35° to about 40° C.

Processing according to the present invention can be carried out using conventional processing equipment. Alternatively, it can be carried out using what is known in the art as "low volume thin tank" processing systems having either rack and tank or automatic tray designs. Such processing methods and equipment are described, for example, in U.S. Pat. No. 5,436,118 (Carli et al) and publications noted therein.

The following examples are presented to illustrate the practice of this invention, and are not intended to be limiting in any way. Unless otherwise indicated, all percentages are by weight.

EXAMPLES 1–2

Bleaching of Color Negative Films

Two peroxide bleaching solutions were evaluated for bleaching effectiveness according to the present invention.

Samples of KODAK GOLD PLUST™ 100 color negative film (containing silver bromoiodide emulsions) were exposed 1/25 second to a step wedge test object using a DLVA filter and 3000K illumination on a conventional 1B sensitometer, and processed at 38° C. using the following protocol. The bleaching time was varied to determine bleaching effectiveness.

| | |
|---|---|
| 3.25 minutes | Development* |
| 1 minute | Stop solution (1% v/v $H_2SO_4$) |
| 1 minute | Water wash |
| 0–8 minutes | Bleaching |
| 3 minutes | Water wash |
| 4 minutes | Fixing** |
| 3 minutes | Water wash |
| 1 minute | KODAK PHOTO-FLO ™ rinse |
| 5 minutes | Dry. |

*The developing solution (per liter) was an aqueous solution of potassium carbonate (34.3 g), potassium hydrogen carbonate (2.3 g), sodium sulfite (3.7 g), potassium iodide (1.2 mg), sodium bromide (1.3 g), diethylenetriaminepentaacetic acid (40% w/w, 8.4 g), hydroxylamine sulfate (2.4 g) and KODAK ™ Color Developing Agent CD4 (4.5 g), and had a pH of 10.05.
**The fixing solution (per liter) was an aqueous solution of sodium metabisulfite (11.8 g) and a solution (162 ml) of ammonium thiosulfate (56.5%) and ammonium sulfite (4%), and had a pH of 6.5. KODAK PHOTO-FLO ™ is a commercially available rinse.

For Example 1, the bleaching solution contained hydrogen peroxide (1.96 mol/l, 6% w/w), sodium chloride (0.35 mol/l) and 1-hydroxyethylidene-1,1-diphosphonic acid (0.004 mol/l), and was adjusted to pH 10 with sodium hydroxide.

Example 2 was similar except that the bleaching solution contained hydrogen peroxide at 0.98 mol/l.

Residual silver (g/m$^2$) was determined by X-ray fluorescence using conventional procedures. The results are tabulated below in Table I (also includes the amount of residual silver without any bleaching). Bleaching is considered complete when residual silver level is less than 0.1 g/m$^2$.

TABLE I

| Step Number | No Bleaching (g/m$^2$) | Example 1: 4 minutes bleaching (g/m$^2$) | Example 2: 8 minutes bleaching (g/m$^2$) |
|---|---|---|---|
| 1 (Dmax) | 1.25 | 0.07 | 0.04 |
| 2 | 1.19 | 0.06 | 0.06 |

TABLE I-continued

| Step Number | No Bleaching (g/m$^2$) | Example 1: 4 minutes bleaching (g/m$^2$) | Example 2: 8 minutes bleaching (g/m$^2$) |
|---|---|---|---|
| 3 | 1.14 | 0.06 | 0.07 |
| 4 | 1.10 | 0.07 | 0.06 |
| 5 | 1.05 | 0.09 | 0.05 |
| 6 | 0.99 | 0.08 | 0.04 |
| 7 | 0.93 | 0.07 | 0.03 |
| 8 | 0.87 | 0.06 | 0.04 |
| 9 | 0.81 | 0.05 | 0.05 |
| 10 | 0.75 | 0.05 | 0.04 |
| 11 | 0.68 | 0.05 | 0.02 |
| 12 | 0.62 | 0.05 | 0.01 |
| 13 | 0.56 | 0.05 | 0 |
| 14 | 0.50 | 0.03 | 0 |
| 15 | 0.44 | 0.01 | 0 |
| 16 | 0.39 | 0.01 | 0.01 |
| 17 | 0.37 | 0.01 | 0.01 |
| 18 | 0.36 | 0.03 | 0.01 |
| 19 | 0.36 | 0.03 | 0 |
| 20 | 0.34 | 0.03 | 0 |
| 21 (Dmin) | 0.31 | 0.02 | 0.01 |

The data in Table I indicate that both bleaching solutions used according to this invention effectively bleached the photographic films, albeit within different times. No vesiculation was observed with these bleaching methods.

EXAMPLE 3

Comparison with Known Bleaching Solution Having Low Chloride Level

This example demonstrates the present ion and compares its performance to that of a conventional method (Control A). The exposure and processing protocols of Examples 1–2 were used to process samples of KODACOLOR GOLD™ 100 color negative film.

In Example 3, the bleaching solution contained hydrogen peroxide (0.98 mol/l, 3% w/w), sodium chloride 0.35 mol/l), sodium carbonate (0.025 mol/l), sodium bicarbonate (0.025 mol/l) and 1-hydroxyethylidene-1,1-diphosphonic acid (0.004 mol/l). The pH was adjusted to with sodium hydroxide.

The Control A solution contained hydrogen peroxide (0.98 mol/l, 3% w/w), potassium chloride (0.067 mol/l) and potassium carbonate (0.18 mol/l). The pH was adjusted to 10 with potassium hydroxide. This peroxide bleaching solution is taught in WO-A-92/07300 (noted above).

The residual silver (g/m$^2$) remaining after bleaching was determined for various bleaching times using X-ray fluorescence and conventional methods. The results, evaluated at maximum density, are listed in Table II below. Bleaching was considered complete when the residual silver level was less than 0.1 g/m$^2$.

TABLE II

| Bleaching Time (seconds) | Example 3 (g/m$^2$) | Control A (g/m$^2$) |
|---|---|---|
| 0 | 1.59 | 1.42 |
| 60 | 1.06 | 1.28 |
| 120 | 0.49 | 0.96 |
| 240 | 0.17 | 0.51 |
| 480 | 0.05 | 0.20 |

It is clear from the data shown in Table II that the present invention provided faster and more complete bleaching than the method of the prior art. No vesiculation was observed with the practice of the present invention.

EXAMPLES 4–5

Bleaching Comparisons Using Various Chloride Concentrations

Samples of KODAK GOLD PLUS 100™ color negative film were exposed and processed according to the protocols described above in Example 1–2. These samples were treated with three different bleaching solutions for times up to 8 minutes.

The Control C solution contained hydrogen peroxide (0.98 mol/l), sodium chloride (0.1 mol/l) and 1-hydroxyethylidene-1,1-diphosphonic acid (0.012 mol/l), and its pH was adjusted to 10 using sodium hydroxide.

In Examples 4 and 5, the bleaching solutions were similar but contained more sodium chloride (0.35 and 0.50 mol/l, respectively).

The residual silver (g/m$^2$) at maximum density was measured using conventional X-ray fluorescence techniques, and the results are tabulated in Table III below. Bleaching was considered complete when the residual silver level was less than 0.1 g/m$^2$. Table III also contains data from conventional processing using a conventional FLEXICOLOR™ Bleach III bleaching solution (Control B).

TABLE III

| Bleaching Time (sec) | Example 4 | Example 5 | Control B | Control C |
|---|---|---|---|---|
| 0 | 1.19 | 1.19 | 1.19 | 1.19 |
| 60 | 0.50 | 0.56 | 0.10 | 0.54 |
| 120 | 0.23 | 0.23 | 0.07 | 0.31 |
| 240 | 0.12 | 0.09 | 0.06 | 0.17 |
| 480 | 0.04 | 0.03 | 0.03 | 0.11 |

These data indicate that the bleaching solutions of the present invention provide more complete bleaching than the Control C solution containing much less chloride ion. Even after 8 minutes, the Control C solution failed to bleach a significant amount of silver in the film samples. Thus, low levels of chloride ion cannot be used effectively.

EXAMPLES 6–7

Use of Various Sequestering Agents

Samples of KODAK GOLD PLUS 100™ color negative film were exposed and processed according to the protocols described above in Example 1–2. These samples were treated with two different bleaching solutions for times up to 8 minutes.

In Example 6, the bleaching solution contained hydrogen peroxide (0.98 mol/l), sodium chloride (0.35 mol/l) and nitrilo-N,N,N-trimethylenephosphonic acid (0.004 mol/l), and its pH was adjusted to 10 using sodium hydroxide.

In Example 7, the bleaching solution was similar but contained diethylenetriaminepentaacetic as the sequestering agent (0.004 mol/l).

The residual silver (g/m$^2$) at maximum density was measured using conventional X-ray fluorescence techniques, and the results are tabulated in Table IV below. Bleaching was considered complete when the residual silver level was less than 0.1 g/m$^2$. Table IV also contains data from processing without bleaching.

TABLE IV

| Step No. | No Bleach | Example 6 After 8 minutes | Example 7 After 8 minutes |
|---|---|---|---|
| 1 | 1.25 | 0.04 | 0.03 |
| 2 | 1.19 | 0.04 | 0.04 |
| 3 | 1.14 | 0.04 | 0.04 |
| 4 | 1.10 | 0.04 | 0.02 |
| 5 | 1.05 | 0.04 | 0.01 |
| 6 | 0.99 | 0.04 | 0.02 |
| 7 | 0.93 | 0.04 | 0.04 |
| 8 | 0.87 | 0.03 | 0.04 |
| 9 | 0.81 | 0.02 | 0.03 |
| 10 | 0.75 | 0.03 | 0.02 |
| 11 | 0.68 | 0.04 | 0.01 |
| 12 | 0.62 | 0.03 | 0.01 |
| 13 | 0.56 | 0.01 | 0.02 |
| 14 | 0.50 | 0.02 | 0.02 |
| 15 | 0.44 | 0.02 | 0.02 |
| 16 | 0.39 | 0.01 | 0.02 |
| 17 | 0.37 | 0.00 | 0.02 |
| 18 | 0.36 | 0.00 | 0.02 |
| 19 | 0.36 | 0.00 | 0.02 |
| 20 | 0.34 | 0.00 | 0.02 |
| 21 | 0.31 | 0.00 | 0.02 |

It is clear that bleaching efficiency is not impeded by the use of a sequestrant. The sequestrant was added to improve solution stability.

The invention has been described in detail with particular reference to preferred embodiments thereof, but it will be understood that variations and modifications can be effected within the spirit and scope of the invention.

We claim:

1. A method for processing a color photographic element comprising:

bleaching an imagewise exposed and developed color negative photographic film containing a silver halide emulsion having at least about 80 mol % silver bromide, and from about 0.5 to about 5 mol % silver iodide, with a peroxide bleaching solution consisting essentially of:

a peroxide bleaching agent, and chloride ions present in an amount of at least about 0.35 mol/l.

2. The method of claim 1 wherein said bleaching agent is hydrogen peroxide.

3. The method of claim 1 wherein said bleaching solution comprises said chloride ions in an amount of from about 0.35 to about 2 mol/l.

4. The method of claim 3 wherein said bleaching solution comprises said chloride ions in an amount of from about 0.35 to about 0.75 mol/l.

5. The method of claim 1 wherein said bleaching solution has a pH of from about 8 to about 12.

6. The method of claim 1 wherein said bleaching solution comprises an organic phosphonic acid or salt thereof having the structure (I):

$$R_1N(CH_2PO_3M_2)_2$$

or the structure (II):

$$R_2R_3C(PO_3M_2)_2$$

wherein $R_1$ is hydrogen, an alkyl group of 1 to 12 carbon atoms, an alkylaminoalkylene group wherein the alkyl or alkylene group has 1 to 12 carbon atoms, an alkoxyalkyl group of 1 to 12 carbon atoms, an aryl group of 6 to 10 carbon atoms in the ring, a cycloalkyl group of 5 to 10 carbon atoms in the ring, or a heterocyclic group having 5 to 10 atoms in the ring, $R_2$ is hydrogen, an alkyl group of 1 to 12 carbon atoms, an aryl group of 6 to 10 carbon atoms in the ring, a cycloalkyl group of 5 to 10 carbon atoms in the ring, a heterocyclic group having 5 to 10 atoms in the ring, $—PO_3M_2$ or $—CHR_4PO_3M_2$, $R_3$ is hydrogen, hydroxyl, an alkyl group of 1 to 12 carbon atoms or $—PO_3M_2$, $R_4$ is hydrogen, hydroxyl, an alkyl group of 1 to 12 carbon atoms or $—PO_3M_2$, and M is hydrogen or a water-soluble monovalent cation; or a tertiary aminocarboxylic acid having the structure (III)

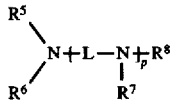

wherein $R^5$, $R^6$, $R^7$ and $R^8$ are independently a hydroxyalkyl group or a carboxyalkyl group, provided at least one of them is a carboxyalkyl group, p is 0, 1, 2 or 3, L is an alkylene group, a $$-(CH_2)_x-(O-(CH_2)_y)_z-$$

group, a 6-membered cyclic alkylene group or an arylene having 6 to 10 carbon atoms in the ring, x and y are independently integers of 2 to 4, and z is an integer of 1 to 3.

7. The method of claim 6 wherein said organic phosphonic acid or salt thereof is 1-hydroxyethylidene-1,1-diphosphonic acid, nitrilo-N,N,N-trimethylenephosphonic acid or diethylenetriamine-N,N,N',N",N"-penta (methylenephosphonic acid), and said tertiary aminocarboxylic acid is diethylenetriaminepentaacetic acid or 2-hydroxypropylenediaminetetraacetic acid.

8. The method of claim 6 wherein said organic phosphonic acid or salt thereof, or tertiary aminocarboxylic acid or salt thereof, is present in an amount of from about 0.001 to about 0.02 mol/l.

9. The method of claim 8 wherein said organic phosphonic acid or salt thereof, or tertiary aminocarboxylic acid or salt thereof, is present in an amount of from about 0.004 to about 0.012 mol/l.

10. The method of claim 1 wherein said peroxide bleaching agent is present in said bleaching solution in an amount of at least about 0.15 mol/l.

11. The method of claim 10 wherein said peroxide bleaching agent is present in said bleaching solution in an amount of from about 0.15 to about 3 mol/l.

12. The method of claim 1 wherein said silver halide emulsion is a silver bromide, silver bromoiodide, silver chlorobromide or silver chlorobromoiodide emulsion.

13. The method of claim 1 wherein said silver halide emulsion has at least about 90 mol % silver bromide, and from 0.5 to 2 mol % silver iodide.

14. The method of claim 13 wherein said silver halide emulsion has at least about 95 mol % silver bromide and no silver chloride.

15. The method of claim 1 wherein said photographic film has 3 color records, each color record having a silver halide emulsion comprising at least about 95 mol % silver bromide and from about 0.5 to about 2 mol % silver iodide.

16. The method of claim 1 wherein said bleaching solution has a pH of from about 9 to about 11.

17. The method of claim 1 wherein said hydrogen peroxide is present in said bleaching solution in an amount of from about 0.9 to about 3 mol/l.

18. The method of claim 1 wherein said color photographic film has an ISO speed of at least 25.

19. The method of claim 18 wherein said color photographic film has an ISO speed of at least 50, and each silver halide emulsion in said film has at least about 95 mol % silver bromide, and from 0.5 to 2 mol % silver iodide.

* * * * *

UNITED STATES PATENT AND TRADEMARK OFFICE

CERTIFICATE OF CORRECTION

PATENT NO. : 5,763,147

DATED : June 9, 1998

INVENTOR(S) : Shirleyanne E. Haye et al:

It is certified that error appears in the above-identified patent and that said Letters Patent is hereby corrected as shown below:

On the title page, item [*] Notice

The term of this patent shall not extend beyond the expiration date of Pat. No. 5,773,202.

Signed and Sealed this

Ninth Day of February, 1999

*Attest:*

*Acting Commissioner of Patents and Trademarks*

*Attesting Officer*